US007934516B1

(12) United States Patent
Jaynes

(10) Patent No.: US 7,934,516 B1
(45) Date of Patent: May 3, 2011

(54) TOILET LEAK CONTAINMENT AND DETECTION SYSTEM

(76) Inventor: Phillip B. Jaynes, Roseville, CA (US)

( * ) Notice: Subject to any disclaimer, the term of this patent is extended or adjusted under 35 U.S.C. 154(b) by 259 days.

(21) Appl. No.: 12/366,628

(22) Filed: Feb. 5, 2009

(51) Int. Cl.
*E03D 11/00* (2006.01)

(52) U.S. Cl. ..... 137/312; 220/571; 4/251.1; 222/108

(58) Field of Classification Search ..... 137/312; 220/571; 4/251.2, 251.1; 222/108
See application file for complete search history.

(56) References Cited

U.S. PATENT DOCUMENTS 2,180,902 A * 11/1939 Herodes et al. ..... 4/251.2
2,499,115 A 1/1947 Shobe
2,479,000 A * 8/1949 Buczkowski ..... 4/251.2
2,644,955 A * 7/1953 Matthews ..... 4/251.2
4,245,666 A * 1/1981 Norris ..... 137/357
4,369,532 A 1/1983 Houchins
D276,177 S 10/1984 Willoughby
4,922,948 A 5/1990 Van Dijk
5,608,922 A * 3/1997 Lewis ..... 4/251.1
5,620,018 A * 4/1997 Carpenter et al. ..... 137/312
6,412,638 B1 7/2002 Carter
7,069,603 B2 7/2006 Flushing

* cited by examiner

*Primary Examiner* — Kevin L Lee

(57) ABSTRACT

This patent discloses a collection system to collect dripped leakage from a toilet discharge flow. The dripped leakage may be from a toilet sealed by a wax ring. The collection system may include a collector, a drain tube, and a catch bottle. The collector may consist of a funnel positioned vertically between a mounting flange and a kick-up. A spout may extend from the funnel at an acute angle to the mounting flange. A wastewater pipe may connect through a center of the kick-up so that a portion of the wastewater pipe resides within a funnel interior of the funnel and a remaining portion resides below the kick-up and outside of the funnel interior.

8 Claims, 6 Drawing Sheets

TOILET LEAK CONTAINMENT AND DETECTION SYSTEM

BACKGROUND

1. Field

The information disclosed in this patent relates to a system to contain and detect leaks from a toilet.

2. Background Information

Toilets are a vital plumbing fixture that aid in the disposal urine and fecal matter bodily wastes. Toilets have been around since at least 2500 B.C. and their basic operation has not change much since that time. Bodily waste may be deposited into a container, usually a toilet bowl. The toilet bowl sits in a pedestal and may include piping that runs from the bowl to a remote location from a bottom of the pedestal. Water then may be dispensed from above onto the waste to wash the waste into the piping and out the bottom of the pedestal.

A lower opening of the pedestal piping may be connected to a drainpipe through a round flange bolted to the pedestal and fit within the drainpipe. The drainpipe may be tube hard plumbed into a building to connect the toilet to a sewer system. To keep foul odors from entering a house, the toilet pedestal may be sealed to the flange with a thick wax ring. During installation, the wax is squeezed between the pedestal and the iron/plastic flange.

To keep urine, dirt, and mold from lodging itself between the pedestal and the floor, a silicone caulk bead typically is placed around the pedestal between the outer bottom perimeter of the pedestal and the floor. This makes it difficult to detect water leaks resulting from a damaged wax ring seal. Water that resides on the floor hidden below the pedestal may cause damage to joists and other wood structural members supporting the floor and any ceiling below the toilet room floor. It is desirable to address these and other issues.

SUMMARY

This patent discloses a collection system to collect dripped leakage from a toilet discharge flow. The dripped leakage may be from a toilet sealed by a wax ring. The collection system may include a collector, a drain tube, and a catch bottle. The collector may consist of a funnel positioned vertically between a mounting flange and a kick-up. A spout may extend from the funnel at an acute angle to the mounting flange. A wastewater pipe may connect through a center of the kick-up so that a portion of the wastewater pipe resides within a funnel interior of the funnel and a remaining portion resides below the kick-up and outside of the funnel interior.

DETAILED DESCRIPTION

Figure 1:
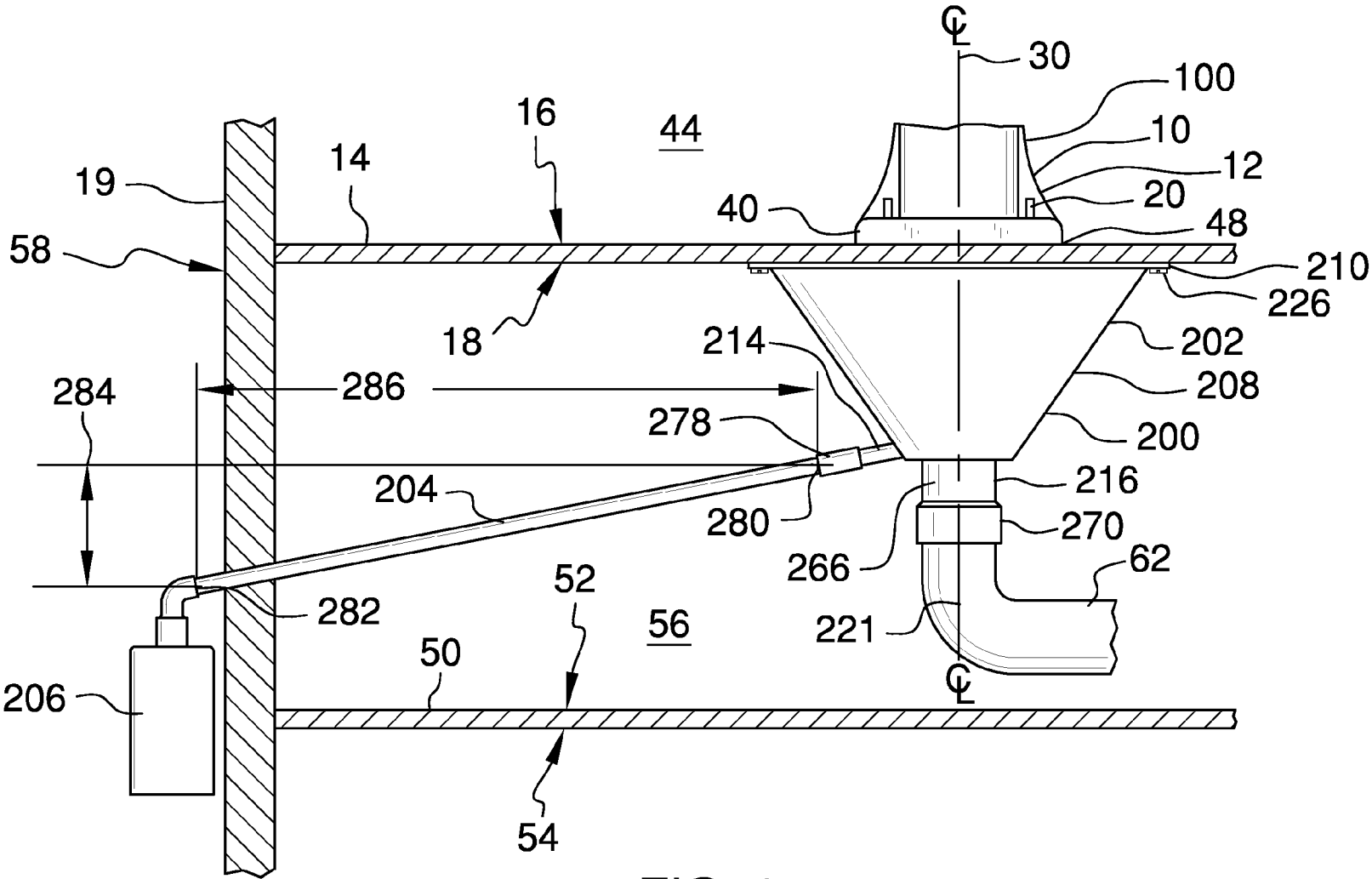
FIG. 1 is a side view of a disposal system 100.
Figure 2:
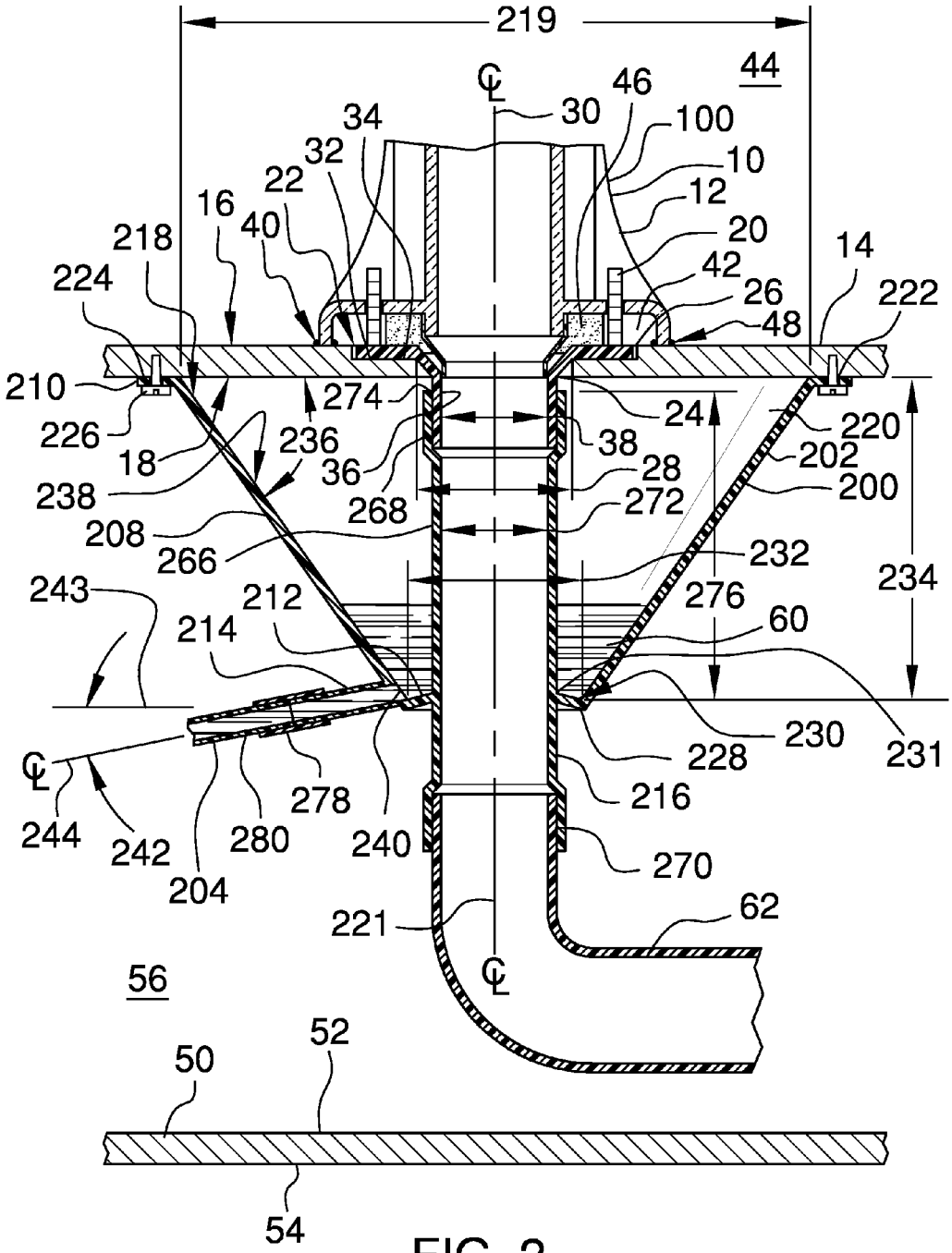
FIG. 2 is side sectional view of disposal system 100.

FIG. 1 is a side view of a disposal system 100. FIG. 2 is side sectional view of disposal system 100. Disposal system 100 may include a collection system 200 added inline to a discharge flow of a toilet 10. Collection system 200 may be used to collect leakage from a toilet discharge flow from below toilet 10.

It may help to have information on toilet 10. Toilet 10 may be a plumbing fixture connected to a disposal system primarily intended for the disposal of human bodily wastes such as urine and fecal matter. Toilet 10 may include a pedestal 12 resting on a floor 14.

A typical flow path for bodily wastes in disposal system 100 may be from pedestal 12 through collection system 200 and into downstream piping 62. If there is a leak, some of the flow may pass into and be retained by collection system 200. Collection system 200 may be instrumentality that combines independent but interrelated elements that may work as a coherent entity to collect, contain, and detect leaks from toilet 10. By gathering together fluid discharge that undesirably has escaped from its typical flow path in disposal system 100, collection system 200 may work to prevent them from causing damage by dripping further downward or laterally. By providing a way for a user to capture falling drops of liquid and to determine the existence of leaks from toilet 10, collection system 200 may make information available to the user to allow that user to make decisions on how to respond to a detected leak.

Floor 14 may include a floor top surface 16 and a floor bottom surface 18 facing downward and in a direction opposite to floor top surface 16. Floor 14 may be a horizontal surface attached perpendicularly to a vertically oriented exterior wall 19. Floor 14 may be a lower horizontal support for pedestal 12.

Pedestal 12 may be a porcelain foundation that supports a toilet seat (not shown) above floor 14. Pedestal 12 may include a bowl (not shown) supported by pedestal 12 into which waste may be deposited. Bolts 20 may be placed around pedestal 12 to secure pedestal 12 in position on floor top surface 16. Bolts 20 may hold-down bolts secured upright within floor 14 at predetermined positions that fit through holes within pedestal 12. Bolts 20 may be screws that screw into nuts to form fasteners.

Floor 14 may have a floor cutout 22 (FIG. 2) having a floor cutout hole 24 surrounded by a countersink 26. Floor cutout hole 24 may be an opening through floor 14 having a floor cutout hole diameter 28 centered on a centerline 30. Countersink 26 may be material removed from floor 14 to create a shaped opening into floor 14 that does not pass through floor 14. The shaped opening provided by countersink 26 may include a circle shape or square shape centered on centerline 30 or may include complicated angle cuts offset from centerline 30.

Disposal system 100 further may include a toilet flange 32. Toilet flange 32 may be a fitting to help channel wastewater downward and out of pedestal 12 while helping to retain pedestal 12 in place. Toilet flange 32 may include a slotted ring 34 connected to a vertical collar 36 that may project down and away from slotted ring 34. Slotted ring 34 may include a hooped shaped annuls having material removed to receive bolts 20 through slotted ring 34. Slotted ring 34 may be square and may include complicated angle cuts offset from centerline 30. Countersink 26 may be shaped to fit slotted ring 34 and may be slightly larger than slotted ring 34 to provide a tight fit between the two. Vertical collar 36 may be a flange outlet pipe having a vertical collar interior diameter 38. Vertical collar 36 may fit through floor cutout hole 24 while slotted ring 34 may rest within countersink 26 on an upper surface of floor 14 with limited space to move within countersink 26. Floor cutout hole diameter 28 may vary to account for different sizes of vertical collar 36.

Pedestal 12 may include a pedestal outer bottom perimeter 40 that rests on floor 14. Pedestal outer bottom perimeter 40 may surround a pedestal interior 42. Pedestal interior 42 may be that hollow area within the region bounded by the material of pedestal 12 that rises from pedestal outer bottom perimeter 40 above floor 14. Pedestal interior 42 may be a hollow space that may be hidden from view and that hides a view of that portion of floor 14 residing below pedestal interior 42. Floor 14 and exterior wall 19 may meet to define surfaces that border a room 44. Room 44 may be an area within a building enclosed by walls and floor and ceiling, such as floor 14 and exterior wall 19.

Disposal system 100 further may include a wax ring 46. Wax ring 46 may be a hooped shaped plug of wax placed within pedestal interior 42 between pedestal 12 and toilet flange 32 to provide a gas and watertight gasket seal that may keep wastewater and foul odors from entering room 44. To keep urine, dirt, and mold from lodging itself between pedestal outer bottom perimeter 40 and floor 14, a silicone caulk bead 48 may be placed around pedestal 12 between pedestal outer bottom perimeter 40 and floor top surface 16.

Water flowing from under pedestal 12 into room 44 may be an indication that wax ring 46 is damaged. However, silicone caulk bead 48 may prevent water from leaving pedestal interior 42 in certain locations to enter a visible portion of room 44. Thus, water leaked radially outward from wax ring 46 into pedestal interior 42 may remain within pedestal interior 42, undetected from a user in room 44. This standing water may pass from floor top surface 16 downward through floor cutout hole 24 and onto floor bottom surface 18.

Disposal system 100 further may include a ceiling 50 having a ceiling top surface 52 and a ceiling bottom surface 54 facing downward and in a direction opposite that of ceiling top surface 52. Ceiling 50 may be an overhead upper surface of a covered space. Ceiling 50 may be a horizontal surface perpendicularly attached to exterior wall 19 to define surfaces of a shallow space 56 with and below floor 14. Shallow space 56 may be a room such as a discrete area within a building enclosed by walls and floor and ceiling, such as floor 14, exterior wall 19, and ceiling 50. In example, a height of shallow space 56 as measured between ceiling top surface 52 and floor bottom surface 18 may be twenty-four inches. Standing water pass onto floor bottom surface 18 further may be hidden from view by ceiling 50. Standing water passing onto floor bottom surface 18 may drip onto ceiling top surface 52 and other contents within shallow space 56 and this may result in damage to these contents from the liquid.

As noted above, collection system 200 may be instrumentality that combines independent but interrelated elements that may work as a coherent entity to contain and detect leaks from toilet 10. Collection system 200 may be a device to catch leaks below pedestal 12 to prevent such leaks from damaging lower building structural elements, such as ceiling 50, joists, and wallboards. Collection system 200 may mitigate a need for ceiling repairs due to such leaks as well as prevent mold, insurance claims, loss of home equity at sale, and other costs from extensive damage. In addition, collection system 200 may port leaked water beyond exterior wall 19 or otherwise to a location where the leaked water may be viewed as part of leak detection.

Collection system 200 may include a collector 202, a drain tube 204, and a catch bottle 206. Collector 202 may be attached within shallow space 56, against floor bottom side 18, and centered on centerline 30 to be positioned under and completely around floor cutout hole 24. Catch bottle 206 may be positioned outside of room 44 and shallow space 56 at a position adjacent to an exterior side 58 of exterior wall 19. Drain tube 204 may be attached to collector 202 and extend from within shallow space 56 to outside of shallow space 56 to reach catch bottle 206.

Drain tube 204 may be attached to collector 202 and extend through shallow space 56 and through exterior wall 19. Catch bottle 206 may be positioned against an exterior side 44 of exterior wall 19 and be attached to drain tube 204 at a position exterior to shallow space 56. Wastewater collected by collector 202 may flow through drain tube 204 and into container 206. A user may view liquid within catch bottle 206 to determine whether toilet 10 is leaking and to determine the rate and extent to which toilet 10 is leaking.

Figure 3:
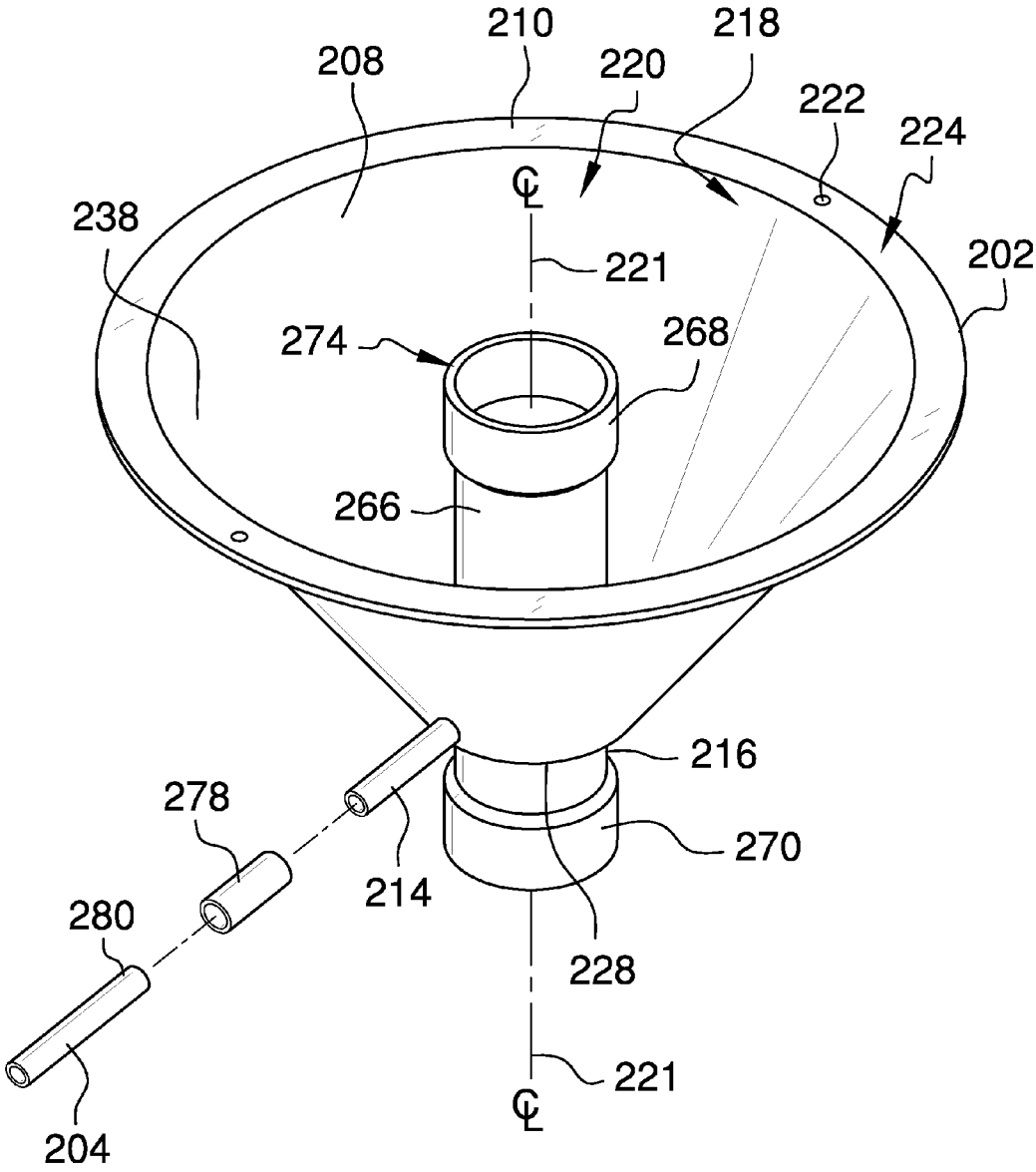
FIG. 3 is an isometric exploded view of collector 202 with drain tube 204.

FIG. 3 is an isometric exploded view of collector 202 with drain tube 204. Collector 202 may be a device to gather gravity fed drippings 60 (FIG. 2) leaked within disposal system 100. Collector 202 may be a product resulting from an injection of plastic material into a mold having a single cavity, where the resulting product is a single piece construction. Collector 202 may consist of a funnel 208 positioned between a mounting flange 210 and a kick-up 212. Collector 202 additionally may consist of a spout 214 extending from funnel 208 and include a wastewater pipe 216 vertically connected as part of collector 202 through a center of kick-up 212.

Funnel 208 may be a conical shape having a wider opening positioned above a narrower opening. Funnel 208 may include a funnel upper opening 218 leading to a funnel interior 220. Funnel upper opening 218 may be an open inlet to funnel interior 220 that may be defined by a funnel upper opening diameter 219. Funnel upper opening diameter 219 may extend between mounting flange 210 and may be centered on centerline 221. Centerline 221 may be a line that divides a shape into equal pieces and substantially may reside within centerline 30 when collector 202 is installed below toilet flange 32. Funnel interior 220 may be a hollow area situated within funnel 208 to receive and retain leaked water 60 that passed through funnel upper opening 218.

Mounting flange 210 may be a ring around an upper surface of funnel 208 having mounting holes 222. Mounting flange 210 may be a rim external to and extending horizontally away from funnel 208. Mounting flange 210 may have a mounting flange top surface 224. In installation, mounting flange top surface 224 may contact floor bottom surface 18 and mounting screws 226 may be fastened through mounting holes 222 and into floor 14. In an example, there may be two mounting holes 222 and two mounting screws 226.

Kick-up 212 may be an upwardly curving surface positioned at a bottom of funnel interior 220 to catch sediments. Kick-up 212 may be a concave surface curving upward from a funnel bottom 228, into funnel interior 220, and to wastewater pipe 216. As a spherically shaped surface, kick-up 212 may intersect with funnel 208 to form a funnel cavity 230 (FIG. 2) having a funnel interior bottom diameter 232. Funnel cavity 230 may have upwardly angled sides that substantially form a V-shape extending up to a kick up top surface 231 of kick-up 212. As sediment deposits enter into funnel 208, the V-shape of funnel cavity 230 may work to consolidate sediment deposits in a thick ring at a bottom of funnel interior 220. This may minimize the amount of sediments traveling into spout 214 and drain tube 204 and, in turn, may work to prevent drain tube 204 from clogging over time.

Funnel interior 220 may have a funnel interior height 234 as measured between a bottom of funnel cavity 230 and mounting flange top surface 224. Funnel 208 may have a funnel angle 236 (FIG. 2) as measured between a funnel interior surface 238 and funnel upper opening 218 at mounting flange top surface 224. Funnel interior height 234, funnel interior bottom diameter 232, and funnel angle 236 may be a function of each other. Here, there may be a relation such that one thing is dependent on another. In an example, a ratio of funnel interior height 234 to funnel interior bottom diameter 232 substantially may be three to one when funnel angle 236 approximately is forty-five degrees. This may aid sediment deposit consolidation.

Funnel 208 may include a funnel drain port opening 240. Funnel drain port opening 240 may be a hole through funnel 208. In one example, funnel drain port opening 240 may be positioned above kick-up top surface 231 such that funnel cavity 230 is continuous. This may prevent sediments from entering spout 214, but initially may not allow leaked water 60 to flow into spout 214 until leaked water 60 has reached kick-up top surface 231. In another example, funnel drain port opening 240 may be positioned to intersect funnel cavity 230 such that funnel cavity 230 is discontinuous. This may allow leaked water 60 to flow into spout 214 when leaked water 60 is at a minimum level.

Spout 214 may be a hollow tube extended from an outlet of funnel drain port opening 240. Spout 214 may work with funnel drain port opening 240 to allow leaked water 60 to pass from funnel interior 220, through spout 214, and into drain tube 204. It may be important to utilize gravity to help urge leaked water 60 to flow through spout 214. In one example, spout 214 may be positioned at a spout angle 242 as measured downward from a horizontal plane 243, such as mounting flange top surface 224 to a spout centerline 244 passing longitudinally through a center of spout 214. Spout 214 may extend from funnel 208 at an acute angle to the mounting flange 210, such as at an angle less than 90 degrees but greater than zero degrees. A downward flow through spout 214 may be a function of a height of leaked water 60, which itself may be a function of funnel angle 236. Thus, a ratio between funnel angle 236 and spout angle 242 may be two to one in one example.

Wastewater pipe 216 may be a tube to assist in transmitting bodily wastes such as urine and fecal matter from toilet flange 32 into downstream piping 62, such as a toilet bend 62. Wastewater pipe 216 may include a sleeve conduit 266 connected between a toilet flange sleeve 268 and a toilet bend sleeve 270. Sleeve conduit 266 may be a hollow tube having a sleeve conduit interior diameter 272. In one example, sleeve conduit interior diameter 272 may be centered on centerline 221 and substantially may equal vertical collar interior diameter 38. Importantly, sleeve conduit 266 may be connected through kick-up 212 so that a portion of sleeve conduit 266 resides within funnel interior 220 and a remainder may reside below kick-up 212 outside of funnel interior 220.

Water leaked from disposal system 100 may be a function of an amount of water flowing through disposal system 100. Further, the travel paths of water 60 along floor bottom surface 18 may vary as a function of the shape and texture of floor bottom surface 18 and the amount of water leaked from disposal system 100. To account for this, it may be important for funnel upper opening diameter 219 to be a function of sleeve conduit interior diameter 272. Here, funnel upper opening diameter 219 may be dependent upon sleeve conduit interior diameter 272. In one example, a ratio of funnel upper opening diameter 219 to sleeve conduit interior diameter 272 approximately may be five to one.

Toilet flange sleeve 268 may be an upper end piece of wastewater pipe 216 having a diameter large enough to receive vertical collar 36. With toilet flange sleeve 268 serving as an upwardly orientated female piece and vertical collar 36 serving as a downwardly oriented male piece, flow through wastewater pipe 216 may proceed uninterrupted. Toilet flange sleeve 268 may have a toilet flange sleeve top 274 at an uppermost surface and have a toilet flange sleeve top height 276 as measured from a bottom of funnel cavity 230 and toilet flange sleeve top 274. It may be important that toilet flange sleeve top 274 not contact floor bottom surface 18 to allow installation of collector 202. Here, toilet flange sleeve top height 276 may be a function of funnel interior height 234. In one example, a ratio of funnel interior height 234 to toilet flange sleeve top height 276 may be ten to nine.

Toilet bend sleeve 270 may be a lower end piece of wastewater pipe 216 having a diameter large enough to receive downstream piping, such as a toilet bend 62. With toilet bend sleeve 270 serving as a downwardly orientated female piece and toilet bend 62 serving as an upwardly oriented male piece, flow through wastewater pipe 216 may proceed uninterrupted.

As noted above, collection system 200 may include collector 202, drain tube 204, and catch bottle 206. Drain tube 204 may be a conduit that may consist of a long, cylindrical hollow object to conduct liquid 60 away from collector 202 and towards catch bottle 206. Collection system 200 further may include a coupler 278 to secure a drain tube first end 280 of drain tube 204 to a distal end of spout 214. Coupler 278 may be a mechanical device where a first half serves to connect drain tube first end 280 of drain tube 204 and a second half serves to connect an end of spout 214 that may be adjacently located next to drain tube first end 280. In one example, coupler 278 may consist of a long, cylindrical hollow object having an interior diameter large enough to receive drain tube first end 280 and spout 214. Coupler 278 may be a ½-inch coupler that may be primer and glued into place.

Drain tube 204 may include a drain tube second end 282 at an end of drain tube 204 that is opposite that on which drain tube first end 280 may be located. To allow gravity to urge leaked water 60 along drain tube 204, it may be important for drain tube first end 280 to be positioned above and at a drain tube height 284 from drain tube second end 282 as a function of a drain tube length 286 of drain tube 204 as measured between drain tube first end 280 and drain tube second end 282. In one example, a ratio of drain tube length 286 to drain tube height 284 may be five to one.

Figure 4:
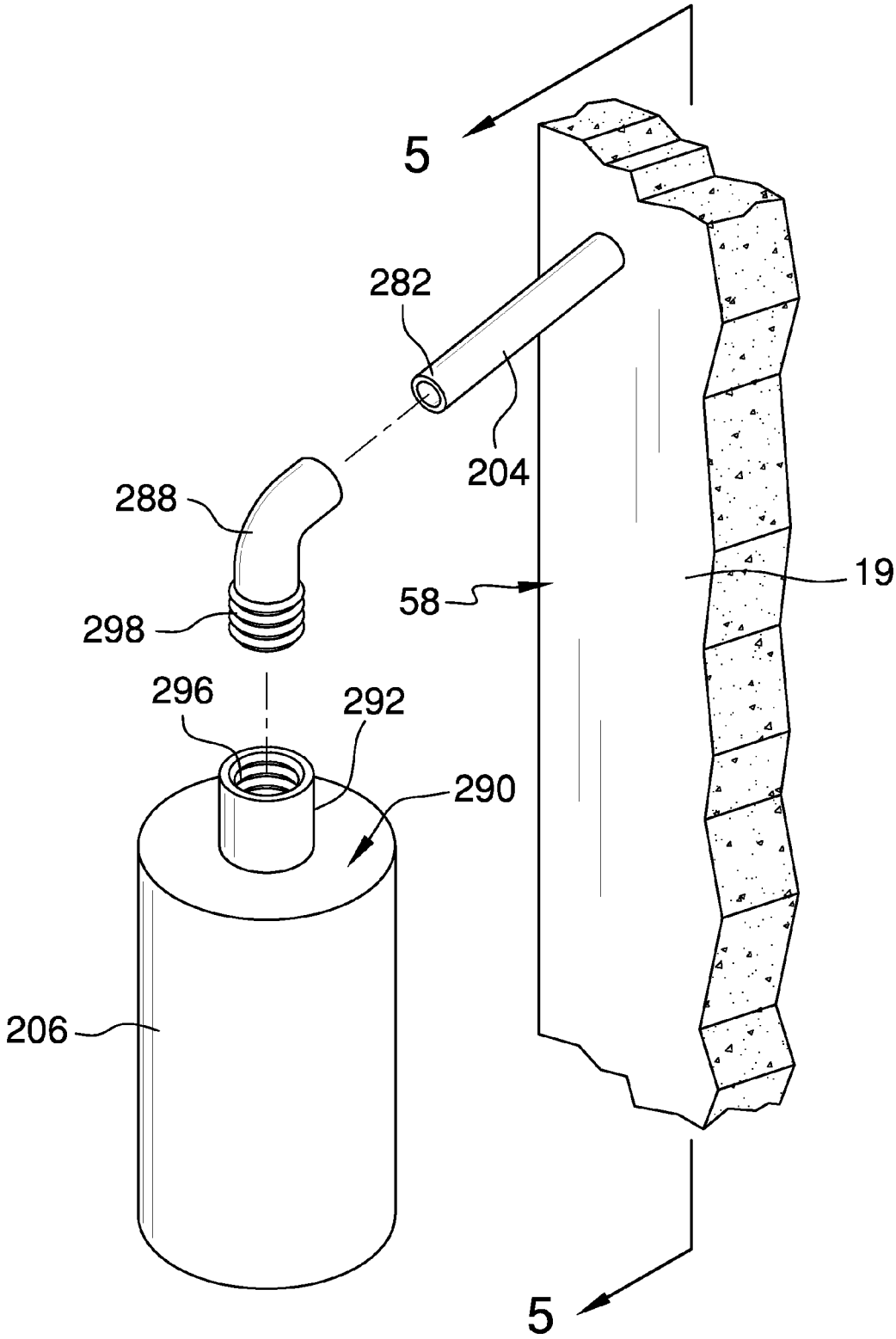
FIG. 4 is an isometric exploded view of catch bottle 206 and a bottle elbow 288.
Figure 5:
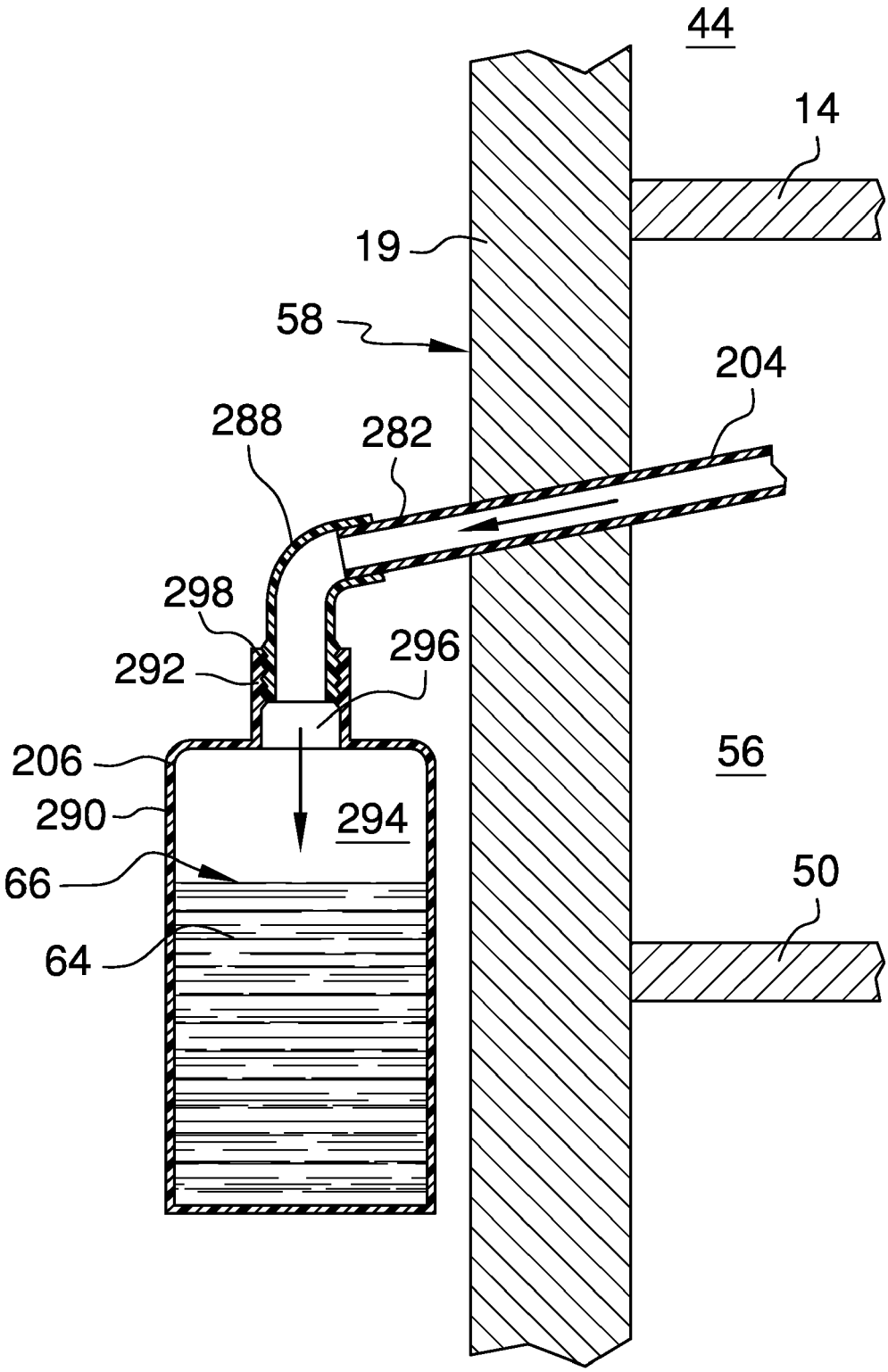
FIG. 5 is a section view of catch bottle 206 generally taken off line 5-5 of FIG. 4.

FIG. 4 is an isometric exploded view of catch bottle 206 and a bottle elbow 288. FIG. 5 is a section view of catch bottle 206 generally taken off line 5-5 of FIG. 4. In assembly, catch bottle 206 may be positioned adjacent to exterior side 58 and drain tube 204 may be passed through exterior wall 19 to connect with catch bottle 206 through bottle elbow 288. In one example, catch bottle 206 may be supported entirely by bottle elbow 288 and may be positioned in an area where a person can walk to and stand while viewing catch bottle 206.

Catch bottle 206 may be vessel to receive and store drainage 64 received from collector 202. Catch bottle 206 may consist of catch bottle walls 290 and a catch bottle neck 292 attached at an upper end of catch bottle walls 290. Catch bottle walls 290 may meet to enclose a catch bottle interior 294 and catch bottle neck 292 may have an internally threaded port hole 296 that may provide access into and out of catch bottle interior 294.

Catch bottle 206 may be clear such that a drainage level 66 of drainage 64 may be seen from outside of catch bottle 206 through catch bottle walls 290. Catch bottle 206 may include markings that provide an indication of a level and/or quantity of drainage level 66. Bottle elbow 288 may be a plumbing fitting having bottle elbow external threads 298 on one end to mate with internally threaded port hole 296 and a sharp bend to angle the other end to receive drain tube second end 282 through a slip fit. In operation, leaked water 60 may pass through drain tube 204 and bottle elbow 288 into catch bottle 206 to become drainage 64.

Figure 6:
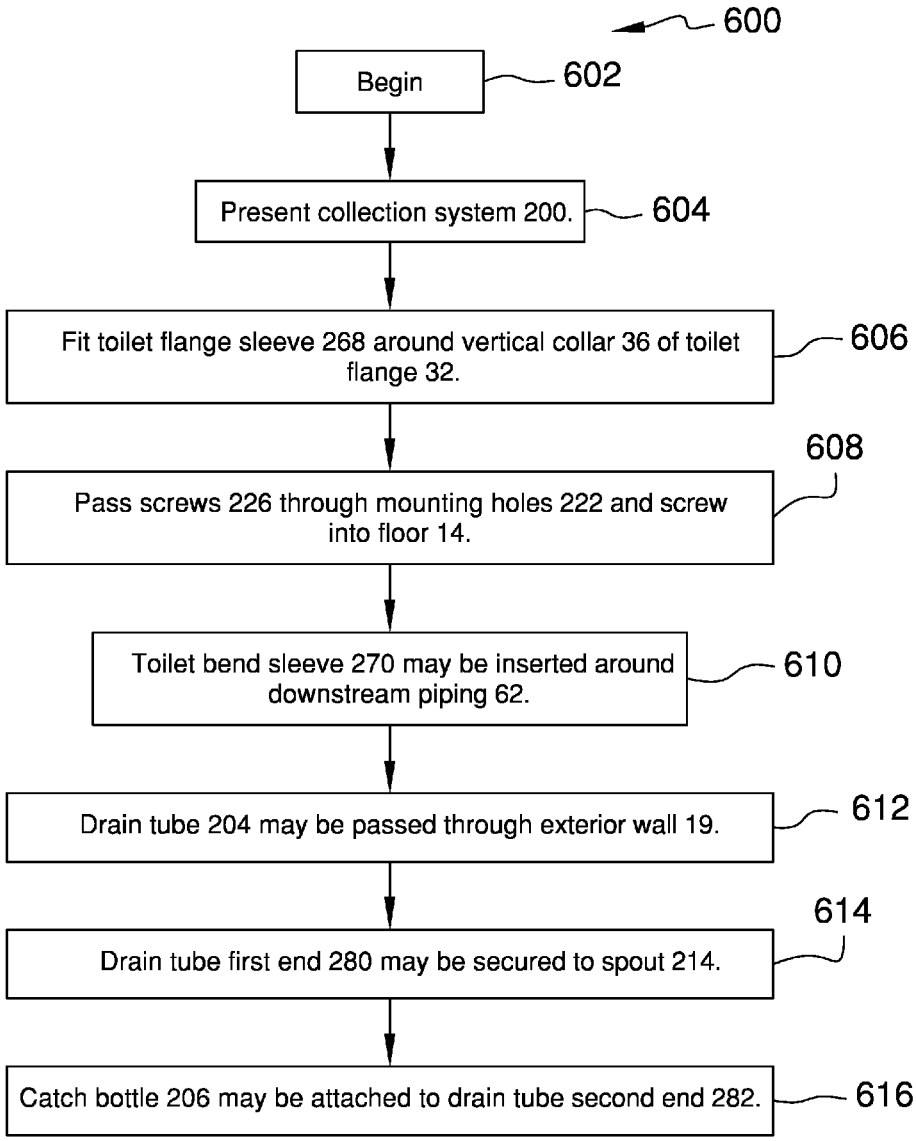
FIG. 6 is a method 600 to assemble and install collection system 200 in disposal system 100.

FIG. 6 is a method 600 to assemble and install collection system 200 in disposal system 100. Collection system 200 may be sold as a collection system kit having written instructions which, when executed, result in an installation of collection system 200 in disposal system 100. Method 600 may begin at step 602. At step 604, method 600 may present collection system 200. At step 606, method 600 may fit toilet flange sleeve 268 around vertical collar 36 of toilet flange 32. At step 608, screws 226 may be passed through mounting holes 222 and screwed into floor 14. At step 610, toilet bend sleeve 270 may be inserted around downstream piping 62.

At step 612, drain tube 204 may be passed through exterior wall 19 until drain tube second end 282 extends from exterior wall 19 and extends away from exterior side 58. This may involve drilling a hole through exterior wall 19 at an angle. At step 614, drain tube first end 280 may be secured to spout 214. In an example, drain tube first end 280 and spout 214 may be inserted into coupler 278 from opposite ends of coupler 278. At step 616, catch bottle 206 may be attached to drain tube second end 282. In an example, drain tube second end 282 may be slip fit into an end of bottle elbow 288 and internally threaded port hole 296 of catch bottle 206 may be screwed onto bottle elbow external threads 298 of bottle elbow 288.

The collection system may be used to contain and provide an indication of a leaking toilet. The collection system may consist of a plastic funnel-shaped element that may be installed around the upper portion of the toilet bend. An upper end of a central sleeve may seat on the underside of a toilet flange. Its upper end may feature a flange that may seat flush against the underside of the subflooring. Located towards the lower end of the system may be a ½-inch drain port. This may be connected to a length of ½-inch drain pipe. An outer end of the drain pipe may be connected to a threaded elbow and a small, transparent catch bottle that may be concealed in a basement, utility room, closet, or related location. The collection system also may be configured in a bisected, existing construction model that may be bonded in place with a standard solvent-based cement.

The collection system may fulfill a need to improve a typical toilet installation. The appealing features of the collection system may be its simplicity, convenience, efficiency, and the protection it may afford. This collection system may be relatively easily added during the rough-in phase of a new bathroom. It also may be retrofitted to existing fixtures located over an unfinished or suspended ceiling system. In use, the collection system may serve to contain any leakage from the wax ring seal of the fixture, thereby preventing damage to the ceiling below and may help to limit damage to any joists or related structural members. The catch bottle also may serve as an easily checked indicator of any leakage.

The information disclosed herein is provided merely to illustrate principles and should not be construed as limiting the scope of the subject matter of the terms of the claims. The written specification and figures are, accordingly, to be regarded in an illustrative rather than a restrictive sense. Moreover, the principles disclosed may be applied to achieve the advantages described herein and to achieve other advantages or to satisfy other objectives, as well.

What is claimed is:

1. A collection system to collect dripped leakage from a toilet discharge flow where that dripped leakage is from a toilet sealed by a wax ring, the collection system comprising:

a collector consisting of a funnel positioned vertically between a mounting flange and a kick-up, a spout extending from the funnel at an acute angle to the mounting flange, a wastewater pipe connected through a center of the kick-up so that a portion of the wastewater pipe resides within a funnel interior of the funnel and a remaining portion resides below the kick-up and outside of the funnel interior;

a drain tube; and a catch bottle.

2. The collection system of claim 1, further comprising:

a coupler to fix a drain tube first end of the drain tube to the spout.

3. The collection system of claim 2, where the catch bottle consists of catch bottle walls and a catch bottle neck positioned at an upper end of the catch bottle walls, the collection system further comprising:

a bottle elbow to fix a drain tube second end of the drain tube to the catch bottle neck.

4. The collection system of claim 1, where the kick-up is an upwardly curving surface positioned at a bottom of the funnel interior that forms a funnel cavity with the funnel.

5. The collection system of claim 4, where the funnel cavity is a V-shaped funnel cavity, where the funnel cavity includes a funnel interior bottom diameter, where the funnel interior includes a funnel interior height as measured between a bottom of the funnel cavity and a mounting flange top surface of the mounting flange, where the funnel has a funnel angle as measured between a funnel interior surface and a funnel upper opening at a mounting flange top surface, and where the funnel interior height, the funnel interior bottom diameter, and the funnel angle are a function of each other.

6. The collection system of claim 4, where the funnel interior includes a funnel interior height as measured between a bottom of the funnel cavity and a mounting flange top surface, where the wastewater pipe includes a sleeve conduit connected between a toilet flange sleeve and a toilet bend sleeve, where the toilet flange sleeve includes a toilet flange sleeve top at an uppermost surface and includes a toilet flange sleeve top height as measured between a bottom of the funnel cavity and the toilet flange sleeve top, and where the toilet flange sleeve top height is smaller than and is a function of the funnel interior height.

7. The collection system of claim 1, where the funnel is a conical shape having a funnel upper opening leading to the funnel interior, where the funnel upper opening includes a funnel upper opening diameter, where the wastewater pipe includes a sleeve conduit connected between a toilet flange sleeve and a toilet bend sleeve, where the sleeve conduit includes a sleeve conduit interior diameter, and where the funnel upper opening diameter is larger than and is a function of the sleeve conduit interior diameter.

8. The collection system of claim 1, where the funnel includes a funnel angle as measured between a funnel interior surface and a funnel upper opening at a mounting flange top surface, where the spout is positioned at a spout angle as measured downward from a mounting flange top surface to a spout centerline passing longitudinally through a center of spout, and where the funnel angle is greater than and is a function of the spout angle.

* * * * *